US006684545B2

(12) United States Patent
Wohlleb

(10) Patent No.: US 6,684,545 B2
(45) Date of Patent: Feb. 3, 2004

(54) PICTURE FRAME

(75) Inventor: Herbert Wohlleb, Maria Enzersdorf (AT)

(73) Assignee: Wohlleb Rahmen KG, Vienna (AT)

( * ) Notice: Subject to any disclaimer, the term of this patent is extended or adjusted under 35 U.S.C. 154(b) by 0 days.

(21) Appl. No.: 10/068,868

(22) Filed: Feb. 11, 2002

(65) Prior Publication Data

US 2002/0108285 A1 Aug. 15, 2002

(30) Foreign Application Priority Data

Feb. 10, 2001 (EP) ..... 01103186

(51) Int. Cl.[7] ..... A47G 1/06
(52) U.S. Cl. ..... 40/732; 40/729; 40/792
(58) Field of Search ..... 40/729, 732, 743, 40/792, 700

(56) References Cited

U.S. PATENT DOCUMENTS

| | | | | |
|---|---|---|---|---|
| 2,623,316 A | | 12/1952 | Knox | |
| 2,881,544 A | | 4/1959 | Knox | |
| 3,965,601 A | * | 6/1976 | Nielsen | 40/792 X |
| 4,967,499 A | | 11/1990 | Rosenberg | |
| 5,197,213 A | | 3/1993 | Borden | |
| 5,230,172 A | * | 7/1993 | Hsu | 40/732 |
| 5,367,802 A | | 11/1994 | Rosenberg | |
| 5,515,628 A | * | 5/1996 | Rankin | 40/700 |
| 5,640,793 A | * | 6/1997 | Fischer | 40/732 X |
| 5,819,458 A | * | 10/1998 | Hadden | 40/700 X |
| 6,305,112 B1 | * | 10/2001 | Hansen | 40/792 X |

FOREIGN PATENT DOCUMENTS

| | | |
|---|---|---|
| DE | 24 04 971 | 8/1975 |
| DE | 42 02 882 | 8/1993 |
| EP | 0 367 129 | 5/1990 |
| FR | 2 251 296 | 6/1975 |
| JP | 10057210 | 3/1998 |
| WO | 99/62385 | 9/1999 |

OTHER PUBLICATIONS

European Search Report, dated Jun. 22, 2001 (4 pgs.).

* cited by examiner

*Primary Examiner*—Joanne Silbermann
(74) *Attorney, Agent, or Firm*—Shlesinger, Arkwright & Garvey LLP

(57) ABSTRACT

Picture frame with framing bars connected to a base frame and with a device for mounting a picture which can be fitted within the base frame with lateral and rearward clearance to its framing bars on the base frame by means of retaining/spacer devices. The device for mounting a picture has a first profiled frame for holding a glass plate or transparent plastic plate and/or a passe-partout and/or a picture, a second profiled frame, whose external dimensions are smaller than the external dimensions of the first profiled frame, connected to and arranged beneath the first profiled frame, and a pressure plate pressing against the glass plate or transparent plastic plate and/or the passe-partout and/or the picture. The retaining/spacer devices can be inserted into the second profiled frame and connected to the framing bars of the base frame.

16 Claims, 1 Drawing Sheet

PICTURE FRAME

CROSS REFERENCE TO RELATED APPLICATIONS

This application claims the priority of European Patent Application No. 01 103 186.1, filed Feb. 10, 2001, which is incorporated herein by reference.

FIELD OF THE INVENTION

The invention concerns a picture frame with framing bars connected to a base frame according to the preamble of claim 1.

BACKGROUND OF THE INVENTION

Conventional picture frames consist of a frame of wooden, plastic or metal bars which have a groove formed on the inside edge at the rear into which a glass plate or transparent plastic plate and/or a passe-partout and/or a picture and/or a rear panel can be inserted and held in place in the frame by means of retaining/clamping devices at the rear. In these known picture frames the pictures lie on the rear panel.

There are further picture frames known which comprise a glass or transparent plastic plate and a rear panel and which are held together by means of clamping devices at the edges. Pictures are positioned between the glass or transparent plastic plate and the rear panel, possibly with the use of a passe-partout.

OBJECTS AND SUMMARY OF THE INVENTION

A task of the present invention is to devise a picture frame of the aforementioned type in such a way that a picture can be positioned with lateral and rearward clearance to the base frame in order to achieve a special optical effect conveying the impression of depth.

That task is solved by the invention according to claim 1.

Advantageous and purposeful further forms of the solution to the task are given in the sub-claims.

The invention creates a device for mounting a picture which fixes the picture to the base frame with lateral and rearward clearance to the framing bars of, for example, a base frame consisting of wooden bars in such a way that when viewing the picture the impression is conveyed that the picture floats within the base frame because the device for mounting the picture is not visible.

The invention shall be explained in more detail in the following by means of embodiment examples.

DETAILED DESCRIPTION OF THE INVENTION

Figures 1, 2, 3:
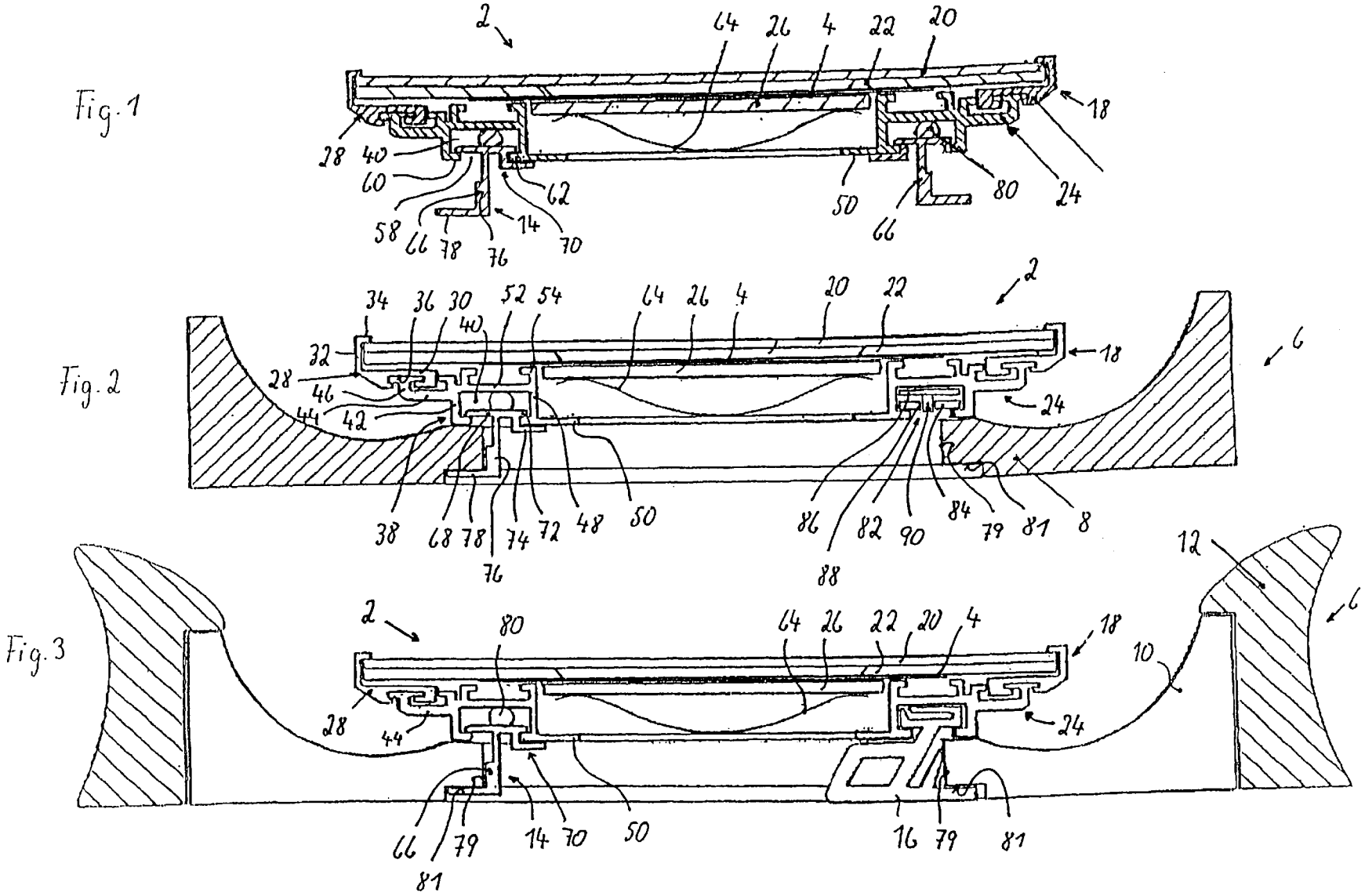
FIG. 1 a schematic section through a special embodiment form of a device for mounting a picture according to the invention.
FIG. 2 a schematic arrangement of the device according to FIG. 1 in a first embodiment form of a base frame.
FIG. 3 a schematic arrangement of the device according to FIG. 1 in a second embodiment form of a base frame.

Identical components in the figures of the drawing are designated with the same reference numbers.

The drawing shows a device 2 for mounting a picture 4 which can be fitted within a base frame 6 shown in FIGS. 2 and 3 with lateral and rearward clearance to the framing bars 8, 10, 12 by means of retaining/clamping devices 14, 16.

The device 2 comprises a first profiled frame 18, preferably made from a transparent plastic, which is provided for holding a glass plate or transparent plastic plate 20 and/or a passe-partout 22 and/or a picture 4. The device 2 also comprises a second profiled frame 24, preferably made from aluminum, which is connected to the first profiled frame 18 and positioned centrally beneath this first profiled frame. The external dimensions of the second profiled frame are smaller than the external dimensions of the first profiled frame. The device 2 also comprises a pressure plate 26 pressing against the glass plate or transparent plastic plate and/or the passe-partout and/or the picture.

The retaining/clamping devices 14, 16 can be inserted into the profiled frame 24 and connected to the framing bars 8, 10 of the base frame 6. The retaining/clamping devices 14, 16 are profiled pieces of metal or plastic and are designed to be at least partly elastic.

The first profiled frame 18 consists of approximately L-shaped profiled bars 28, the first leg 30 of which is provided as a bearing surface for the glass plate or transparent plastic plate and/or the passe-partout and/or the picture, and the other, second leg 32 of which fastens around the edge of the glass plate or transparent plastic plate and/or the passe-partout and/or the picture with an inward-facing bent part 34 arranged at its unattached end. The first leg 30 has a groove 36, which can be formed, for example, as a T-groove or dovetail-shaped groove, cut in the rear on the outer side facing away from the glass plate or transparent plastic plate or passe-partout or picture.

The second profiled frame 24 consists of essentially box-shaped bars 38 which have a void 40 with a rectangular cross-section. The outer wall 42 of the void 40 has an outward-pointing outer bar 44 whose unattached end forms a complement to the groove in the first leg of the L-shaped profiled bars and is provided with a bent part 46 for locating in this groove. An inward-projecting inner bar 50 is formed on the inner wall 48 of the void 40. The upper wall 52 of the void 40 has spacer elements 54 which terminate at the level of the first leg of the L-shaped profile and are also provided as a support for the glass plate or transparent plastic plate and/or the passe-partout and/or the picture.

The lower wall of the void 40 facing away from the glass plate or transparent plastic plate and/or the passe-partout or the picture has a longitudinal opening 58 that is limited by the short wall sections 60, 62 at the sides.

The pressure plate 26 is arranged within the second profiled frame 24 and is pressed upon by several pretensioning springs 64 distributed around the perimeter and which along the edges are sprung between the pressure plate and the inner bar 50 of the second profiled frame 24 and press the pressure plate against the glass plate or transparent plastic plate and/or the passe-partout and/or the picture and so via the pressure plate pretension the glass plate or transparent plastic plate and/or the passe-partout and/or the picture against the bent parts 34 of the first profiled frame 18.

The retaining/clamping devices 14 are formed as approximately T-shaped pieces 66 whose flanges 68 can be inserted into the void 40 of the box-shaped bars 38, thereby fastening behind the short wall sections 60, 62. One end of one part of the flange is formed as a fork 70 whose one leg 72 fastens behind one inner short wall section 62 and whose other leg 74 fastens underneath this short wall section 62. The web 76 of the retaining/clamping device 14 has a bent part 78 which fastens over the framing bars 8, 10 of the base frame 6 at the rear in such a way that in the mounted condition the inner edge 79 of the base frame is positioned between the underside of the box-shaped bar 38 of the second profiled frame 24 and the bent part 78 of the retaining/clamping device 14. The flange 68 has an elastic element 80 on the top, preferably formed by a rubber strip, for pressing the flange against the short wall sections 60, 62 of the void 40 in the box-shaped bar 38 of the second profiled frame 24. The bent part 78 preferably fastens into a recess 81 on the inner edge and the outside of the framing bars 8, 10.

In order to manufacture a rectangular picture frame, four profiled bars 18 and 24 joined as one unit with mitered ends are connected with the help of expanding elements 82 (drawn schematically in FIG. 2) which can be inserted into the voids 40 of the abutting box-shaped bars 38. The expanding elements 82 consist of two sheet metal angles 84, 86, one on top of the other, with a leg width approximately equal to the clear width of the void 40 in the box-shaped bars 38. Both legs of the outer angle 84 have at least one threaded hole 88 into which the grubscrews 90 can be screwed and thus against the lower angle 86, whereby the lower angle is pressed against the inside of the upper wall 52 and the upper angle 84 against the inside of the short wall sections 60, 62 of the opening 58 to the void 40 in the box-shaped bar 38 and consequently the two abutting box-shaped bars are connected together.

The device 2 can be placed in the base frame 6 with the help of at least four retaining/clamping devices 14 by slightly twisting the base frame 6 and the device 2 relative to each other in such a way that retaining/clamping devices 14 can be pressed into the voids 40 of the box-shaped rails 38 in the four corner areas of the device 2 and upon rotating back the inner edge 79 of base frame 6 can be slid beneath the bent parts 78 of the retaining/clamping devices 14. It is also possible to insert retaining/clamping devices 14 just into the voids 40 of two neighboring box-shaped bars 38, then slide two sides of the base frame 6 into these retaining/clamping devices and using elastic clamping elements 16, for example, of plastic, see FIG. 3, to connect the remaining two sides. These elastic clamping elements 16 can also be used alone without the retaining/clamping devices 14.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A picture frame, comprising:

a) a base frame;

b) framing bars connected to the base frame;

c) a device for mounting a picture which can be fitted within the base frame with lateral and rearward clearance to the framing bars on the base frame by retaining/clamping device;

d) the device for mounting a picture including i) a first profiled frame for holding one of a class plate, a transparent plastic plate, a passe-partout, and a picture;

ii) a second profiled frame, whose external dimensions are smaller than external dimensions of the first profiled frame, connected to and arranged beneath the first profiled frame; and iii) a pressure plate for pressing against one of a class plate, a transparent plastic plate, a passe-partout, and a picture; and e) the retaining/spacer device can be inserted into the second profiled frame and be connected to the framing bars of the base frame.

2. Picture frame according to claim 1, wherein:

a) the first profiled frame includes a transparent plastic.

3. Picture frame according to claim 2, wherein:

a) the first profiled frame includes an approximately L-shaped profiled bar, a first leg of which is provided as a bearing surface for one of a glass plate, a transparent plastic plate, a passe-partout, and a picture, and a second leg of which fastens around the edge of one of a glass plate, a transparent plastic plate, a passe-partout, and a picture with an inward-facing bent part arranged at its unattached end, and the first leg has a groove cut in its rear on an outer side facing away from one of a glass plate, a transparent plastic plate, a passe-partout, and a picture.

4. Picture frame according to claim 3, wherein:

a) the second profiled frame includes box-shaped bars which have a void with a rectangular cross-section;

i) an outer wall of which has an outward-pointing outer bar whose unattached end forms a complement to the groove of the first leg of the L-shaped profiled bar and is provided with a bent part for locating in this groove;

ii) an inner wall of which is formed as an inward-projecting inner bar;

iii) an upper wall of which is formed as a spacer element which terminates approximately at the level of the first leg of the L-shaped profiled bar and is also provided as a support for the one of a glass plate, a transparent plastic plate, a passe-partout, and a picture; and iv) a lower wall of which facing away from one of a glass plate, a transparent plastic plate, a passe-partout, and a picture has a longitudinal opening that is limited by a short wall section at a side of the opening.

5. Picture frame according to claim 4, wherein:

a) the retaining/clamping device is formed as approximately T-shaped pieces having a flange which can be inserted into the void of the box-shaped bars and fasten behind the short wall section, and one end of one part of the flange is formed as a fork whose one leg fastens behind one inner short wall section and whose other leg fastens underneath this short wall section, and whose web has a bent part which fastens over the framing bars of the base frame at the rear in such a way that in a mounted condition an inner edge of the base frame is positioned between an underside of the box-shaped bar of the second profiled frame and the bent part of the retaining/clamping device, and the flange has an elastic element on the top for pressing the flange against the short wall section of the void in the box-shaped bar of the second profiled frame.

6. Picture frame according to claim 5, wherein:

a) the elastic element is formed by rubber strips.

7. Picture frame according to claim 3, wherein:

a) the groove is formed as one of a T-groove and a dovetail-shaped groove.

8. Picture frame according to claim 1, wherein:

a) the second profiled frame includes one of metal and plastic.

9. Picture frame according to claim 8, wherein:

a) the second profiled frame includes box-shaped bars which have a void with a rectangular cross-section;

i) an outer wall of which has an outward-pointing outer bar whose unattached end forms a complement to a groove of a first leg of an L-shaped profiled bar and is provided with a bent part for locating in this groove;

ii) an inner wall of which is formed as an inward-projecting inner bar;

iii) an upper wall of which is formed as a spacer element which terminates approximately at the level of the first leg of the L-shaped profiled bar and is also provided as a support for one of a glass plate, a transparent plastic plate, a passe-partout, and a picture; and iv) a lower wall of which facing away from one of a glass plate, a transparent plastic plate, a passe-partout, and a picture has a longitudinal opening limited by a short wall section at a side of the opening.

10. Picture frame according to claim 1, wherein:

a) the retaining/spacer device includes one of profiled pieces of metal and plastic.

11. Picture frame according to claim 1, wherein:

a) the pressure plate is arranged within the second profiled frame and is pressed upon by several pretensioning springs distributed around its perimeter which along the edges are sprung between the pressure plate and an inner bar of the second profiled frame and press the pressure plate against one of a glass plate, a transparent plastic plate, a passe-partout, and a picture.

12. Picture frame according to claim 1, wherein:

a) the second profiled frame includes four profiled box-shaped bars which have a void; and b) in order to provide a rectangular picture frame, the four profiled box-shaped bars are joined as one unit with mitered ends and are connected with the help of expanding elements which can be inserted into voids of abutting box-shaped bars.

13. Picture frame according to claim 12, wherein:

a) the expanding elements include two sheet metal angles, one on top of the other, with a leg width which is approximately equal to a clear width of the void in the box-shaped bars, both legs of an outer angle have at least one threaded hole into which screws can be screwed against an inner angle, whereby the inner angle is pressed against the inside of the upper wall and the outer angle against an inside of a short wall section of the opening to the void in the box-shaped bar, and consequently the two abutting box-shaped bars are connected together.

14. Picture frame according to claim 1, wherein:

a) the retaining/clamping device includes a profiled piece of one of metal and plastic.

15. Picture frame according to claim 1, wherein:

a) the first profiled frame includes an approximately L-shaped profiled bar, a first leg of which is provided as a bearing surface for one of a glass plate, a transparent plastic plate, and a passe-partout, and a picture, and a second leg of which fastens around an edge of one of a glass plate, a transparent plastic plate, a passe-partout, and a picture with an inward-facing bent part arranged at its unattached end, and the first leg has a groove cut in its rear on an outer side facing away from one of a glass plate, a transparent plastic plate, a passe-partout, and a picture.

16. Picture frame according to claim 1, wherein:

a) the second profiled frame includes box-shaped bars which have a void with a rectangular cross-section;

i) an outer wall of which has an outward-pointing outer bar whose unattached end forms a complement to a groove of a first leg of an L-shaped profiled bar and is provided with a bent part for locating in this groove;

ii) an inner wall of which is formed as an inward-projecting inner bar;

iii) an upper wall of which is formed as a spacer element which terminates approximately at the level of the first leg of the L-shaped profiled bar and is also provided as a support for one of a glass plate, a transparent plastic plate, a passe-partout, and a picture; and iv) a lower wall of which facing away from one of a glass plate, a transparent plastic plate, a passe-partout, and a picture has a longitudinal opening that is limited by a short wall section at a side of the opening.

* * * * *